US005307993A

United States Patent [19]

Simonetti et al.

[11] Patent Number: 5,307,993

[45] Date of Patent: May 3, 1994

[54] ROTARY SPRINKLER

[75] Inventors: Sergio G. Simonetti, Westport, Conn.; Paul Aquilina, Kitchener, Canada

[73] Assignee: Melnor Industries, Inc., Moonachie, N.J.

[21] Appl. No.: 824,020

[22] Filed: Jan. 22, 1992

[51] Int. Cl.[5] ..... B05B 3/06

[52] U.S. Cl. ..... 239/247; 239/257; 239/258; 239/436; 239/444

[58] Field of Search ..... 239/246-249, 239/251, 253, 256-258, 273, 436, 442, 443, 446, 447, 455, 557, 558, 562, 579, DIG. 1

[56] References Cited

U.S. PATENT DOCUMENTS

| | | | |
|---|---|---|---|
| 153,311 | 7/1874 | Bristol | 239/443 |
| 1,180,170 | 4/1916 | Marsh et al. | 239/257 |
| 1,866,844 | 7/1932 | De Vos | 239/258 |
| 2,534,016 | 12/1950 | Grelson | 239/258 |
| 2,624,625 | 1/1953 | Magos et al. | 239/436 |
| 2,769,667 | 11/1956 | Spender | 239/253 |
| 3,064,665 | 11/1962 | Martiniak | 239/246 |
| 3,744,721 | 7/1973 | Baumstark, Jr. | 239/253 |
| 3,815,832 | 6/1974 | Floyd | 239/DIG. 1 |
| 4,510,784 | 4/1985 | Hsu | 239/436 |
| 4,905,903 | 3/1990 | Katzer et al. | 239/246 |

FOREIGN PATENT DOCUMENTS

| | | | |
|---|---|---|---|
| 1556884 | 2/1969 | France | 239/436 |
| 1500375 | 8/1989 | U.S.S.R. | 239/447 |
| 2137534 | 10/1984 | United Kingdom | 239/443 |

*Primary Examiner*—Andres Kashnikow
*Assistant Examiner*—Karen B. Merritt
*Attorney, Agent, or Firm*—Heiskell, Donelson, Bearman, Adams, Williams & Kirsch

[57] ABSTRACT

A rotary sprinkler is provided having a stationary base portion, with a water inlet for attachment to a conventional garden hose, and a vertically oriented water outlet having a body portion rotatably secured thereto. A plurality of generally cylindrical arms extend radially from the body portion, with each arm having a nozzle unit disposed on the distal end thereof. Each nozzle unit includes a plurality of nozzles formed therein, and may be selectively positioned longitudinally so as to expose a different number of such nozzles to the water supply. The nozzle unit may be rotated relative to its respective arm, so that the water discharged through the nozzles operates to drive the body/arm assembly about the base. The rotational velocity of the body/arm assembly may be controlled by the user of the sprinkler by adjusting the rotational orientation of the plurality of nozzle units.

24 Claims, 6 Drawing Sheets

ROTARY SPRINKLER

BACKGROUND OF THE INVENTION

1. Field

This invention relates to rotary sprinklers and, more particularly, to such sprinklers having a plurality of selectively adjustable nozzle units.

2. Description of the Prior Art

Rotary sprinklers having a plurality of jet driven arms for distributing water on a lawn or garden have been well known in the yard for a number of years. U.S. Pat. No. 4,905,903, entitled "Sprinkler", discloses a contemporary rotary sprinkler having three arms, or "nozzle supports," with each such arm having a rotatable nozzle head disposed on the distal end thereof. Each nozzle head is selectively rotatable between three independent positions, with a different number of nozzles placed in use in each position. Each nozzle head is also rotatable to a position wherein none of the respective nozzles are in use (i.e., none of the nozzles are in fluid communication with the water supply). The angular orientation of each nozzle head may also be independently adjusted, thereby controlling the rotational velocity of the arm assembly.

Other conventional rotary sprinklers provide two or three arms radially projecting from a central hub, which is rotatably secured to a base, with each arm having a fixed jet operatively disposed thereon. Such sprinklers are typically very inexpensive to manufacture, but do not provide the degree of adjustability required for some applications. Specifically, some conventional sprinklers do not provide means for adjusting the water flow and/or the directional orientation of the nozzles.

Conceptually, the sprinkler disclosed in the '903 patent provides a high degree of adjustability for the spray pattern of the water distributed thereby. Each of the three arms includes a nozzle head with three separate sets of nozzle units, and each of the three nozzle units per arm has a different number of nozzles formed therein. The angular orientation of each nozzle unit may be varied considerably, including a position wherein no nozzles are in operation, so that the rotational velocity of the '903 sprinkler is, at least theoretically, almost infinitely adjustable.

In practice, however, the sprinkler disclosed in the '903 patent has been found to be unnecessarily complicated for its intended purpose. In the vast majority of applications, there is little or no discernible difference between most of the various patterns of water distribution provided by the '903 sprinkler. Similarly, it has been found that there is little or no practical distinction in the effectiveness of the sprinkler when the nozzle units are set at many of the available angular orientations. The conceptual range of rotational velocities available with the '903 sprinkler is unrealistic given the practical limitations in water pressure and bearing efficiency. In short, the unusually complicated operation of the sprinkler disclosed in the '903 patent is not justified by the relatively few advantages provided by its high degree of adjustability.

There is a need in the industry for a rotary sprinkler of simplified design and operation, which provides a suitable variety of water distribution patterns and rotational velocities.

BRIEF SUMMARY OF THE INVENTION

An object of the present invention is to provide a rotary type sprinkler of generally simplified construction. It is another object to provide such a sprinkler with multiple spray settings for varying the water distribution patterns.

A further object of this invention is to provide such a sprinkler which allows selective adjustment of the amount of water distributed onto a lawn. It is also an object of this invention to provide such a sprinkler which is relatively inexpensive to manufacture, and is simple to assemble and use.

In order to obtain these and other objects, a sprinkler is disclosed herein comprising a base having a horizontally disposed water inlet adapted to receive a conventional garden hose, and a vertically oriented outlet. A body is rotatably secured to the base, having a central internal passageway maintained in fluid communication with the base outlet. The body has a plurality of arms extending radially therefrom, each arm having an internal passageway maintained in fluid communication with the central internal passageway in the body, and also having an upward facing opening in its distal end. Each arm further includes a nozzle unit slidably mounted on its distal end, having a plurality of nozzles formed therethrough.

Each nozzle unit is selectively movable longitudinally along its respective arm between multiple positions, with each position placing a different number of the nozzles in fluid communication with the internal passageway through the opening in the distal end of the arm. At least one nozzle on each arm is maintained in constant fluid communication with the internal passageway. Finally, at least one nozzle unit is selectively movable about the axis of its respective arm, whereby the force of water being discharged from such nozzle unit operates to rotate the body relative to the base.

In the preferred embodiment of the sprinkler disclosed herein, the body has three arms integrally formed therewith and extending radially therefrom. In an alternative embodiment, a substantially identical body is disclosed, having just two arms.

DETAILED DESCRIPTION OF THE PREFERRED EMBODIMENT

Figure 1:
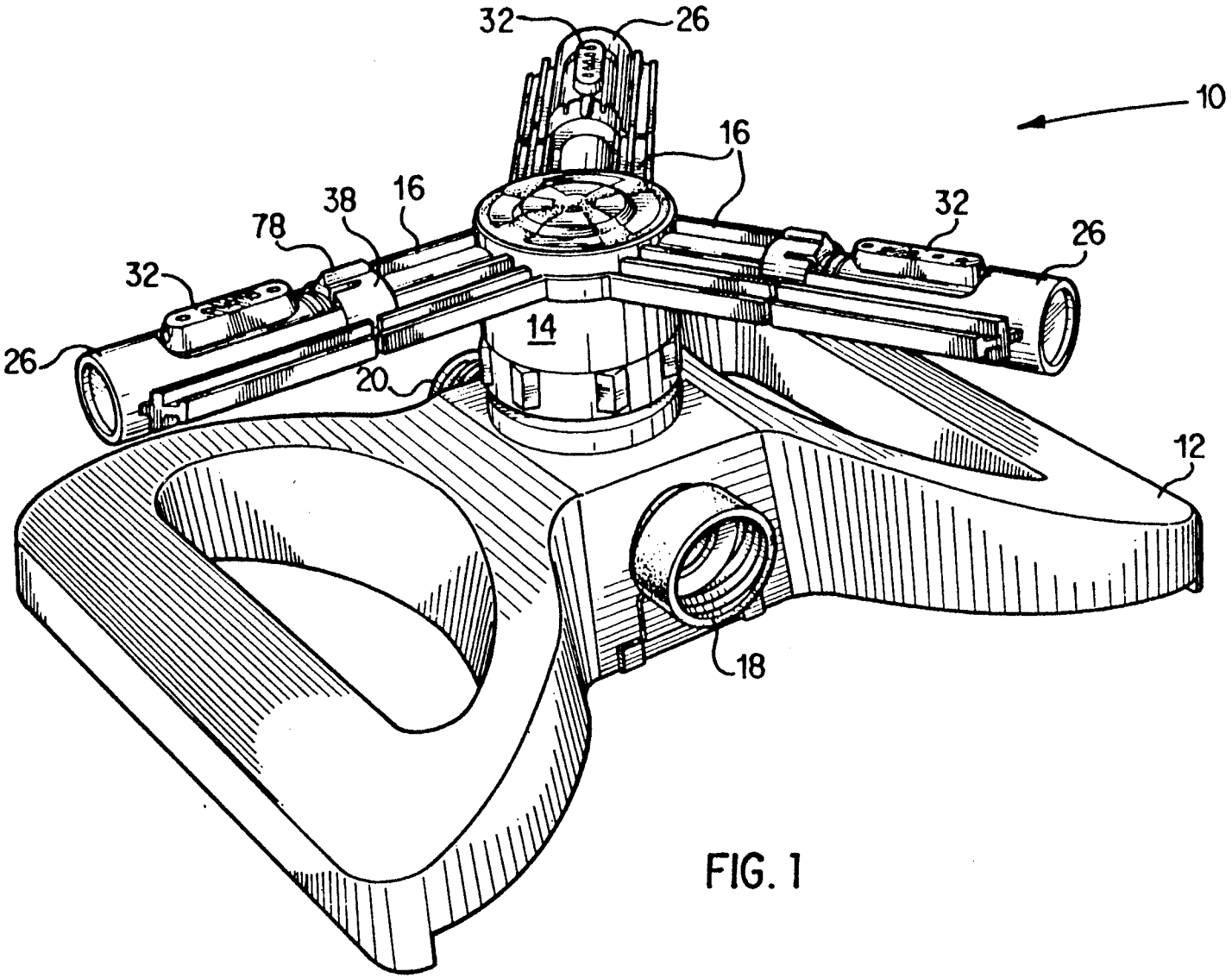
FIG. 1 is a perspective view of the preferred embodiment of the present invention.

Referring initially to FIG. 1, the preferred embodiment of rotary sprinkler 10 is provided with a base 12, a body 14 rotatably mounted to base 12 as described more fully below, and three arms 16 extending radially from the top portion of body 14. Base 12 includes a water inlet 18, having female threads formed therein for engagement with the male end of a conventional water hose (not shown), and water outlet 20, having male threads formed thereon for engagement with the female end of a conventional garden hose. It will be understood that, during normal operation of sprinkler 10, water outlet 20 may be attached to another garden hose or capped by a suitably threaded cap, as desired by the user.

Figure 2:
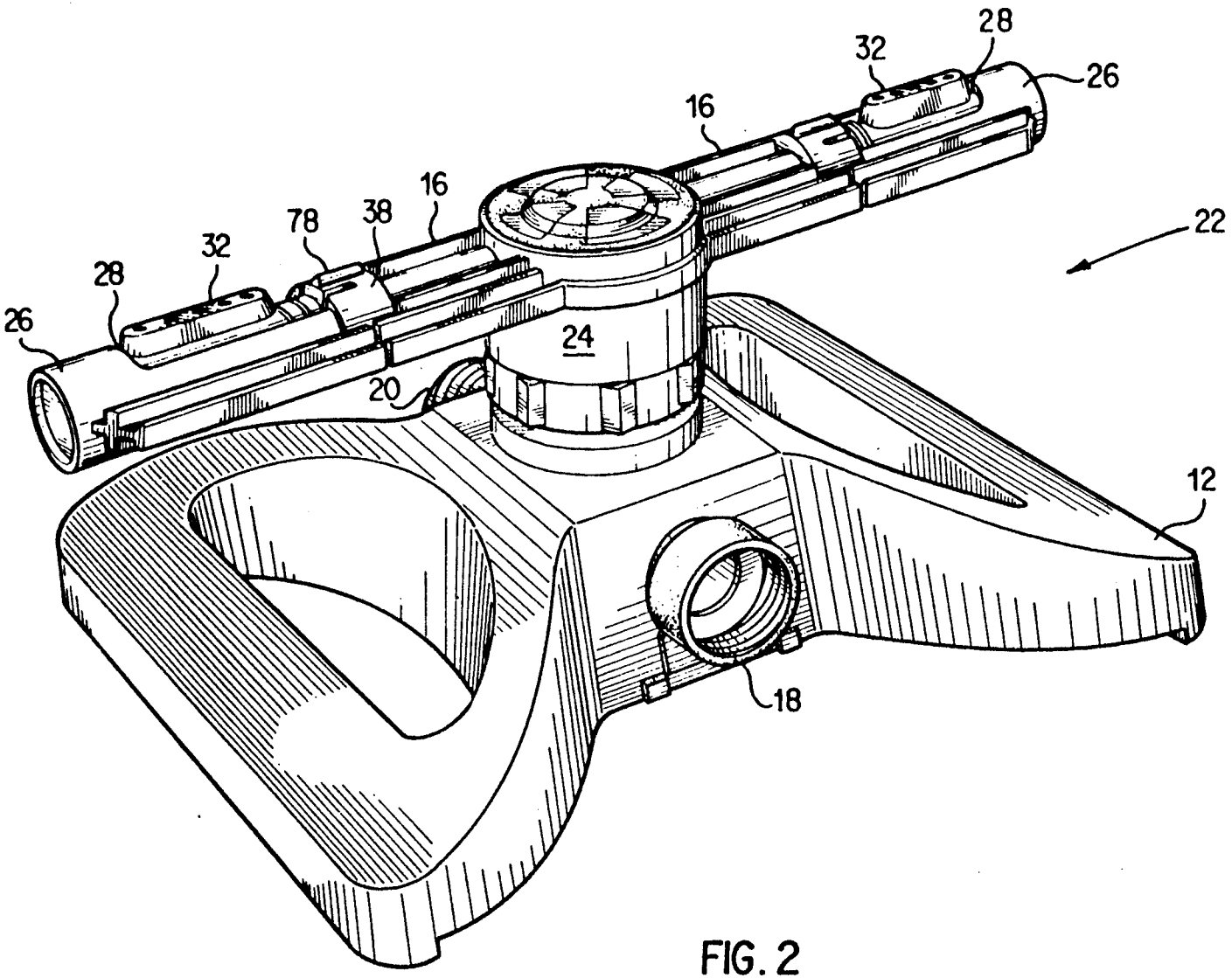
FIG. 2 is a perspective view of an alternative embodiment of the present invention.
Figure 3:
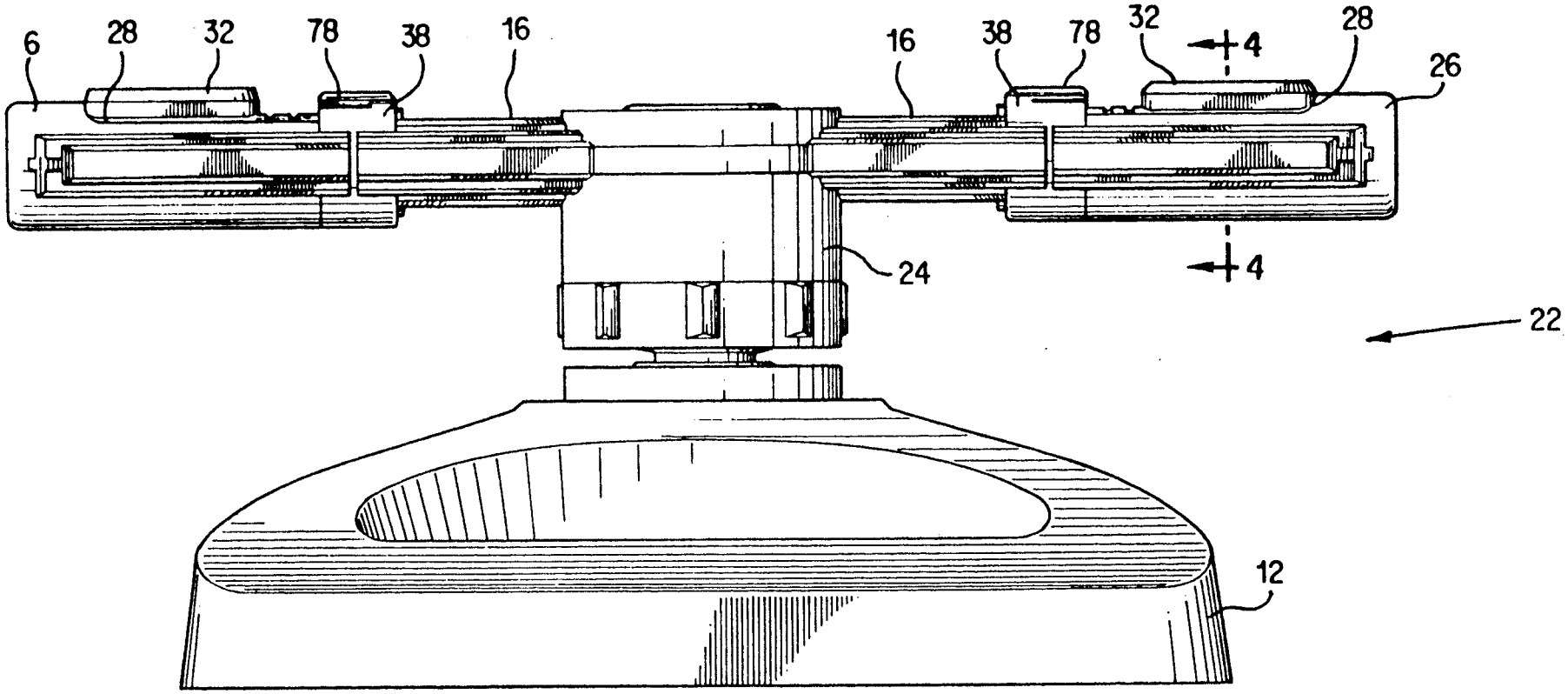
FIG. 3 is a side elevational view of the alternative embodiment shown in FIG. 2.

FIG. 2 illustrates an alternative embodiment designated as sprinkler 22, which comprises a base 12 having a water inlet 18 and water outlet 20 the same as on sprinkler 10. Body 24 of sprinkler 22 is rotatably mounted on base 12, and differs only from body 14 of sprinkler 10 in that only two arms 16 are formed therewith and extending radially therefrom. It is to be understood that, for purposes of this invention, the only practical difference between sprinkler 10 and sprinkler 22 lies in the number of arms incorporated thereon, with bodies 14 and 24 being adapted accordingly. References hereinbelow to the "arm hub" are to be understood as referring to the unitary component comprising either body 14 or body 24 and their respective arms 16, and are equally applicable to both sprinkler 10 and sprinkler 22.

The remainder of this detailed description focuses primarily on the interior components of sprinkler 22, yet those skilled in the art will readily understand that the following discussion is equally applicable to sprinkler 10. The interior configuration of body 14 is substantially identical to that discussed below for body 24, and arms 16 on sprinkler 22 are identical to arms 16 on sprinkler 10. Accordingly, the detailed description of a representative arm 16 is equally applicable to each arm 16, regardless of whether such arm is included on the embodiment of sprinkler 10 or sprinkler 22.

The distal end of each arm 16 includes a nozzle base 26 fixedly secured thereto. Nozzle base 26 has a generally longitudinally oriented, upward facing opening 28 formed therein, which is substantially aligned with opening 30 formed in the distal end of arm 16. A number of plastic compounds and attachment methods are well suited for forming the arm hub and nozzle bases 26, with bases 26 preferably being ultrasonically welded onto arms 16.

Figure 4:
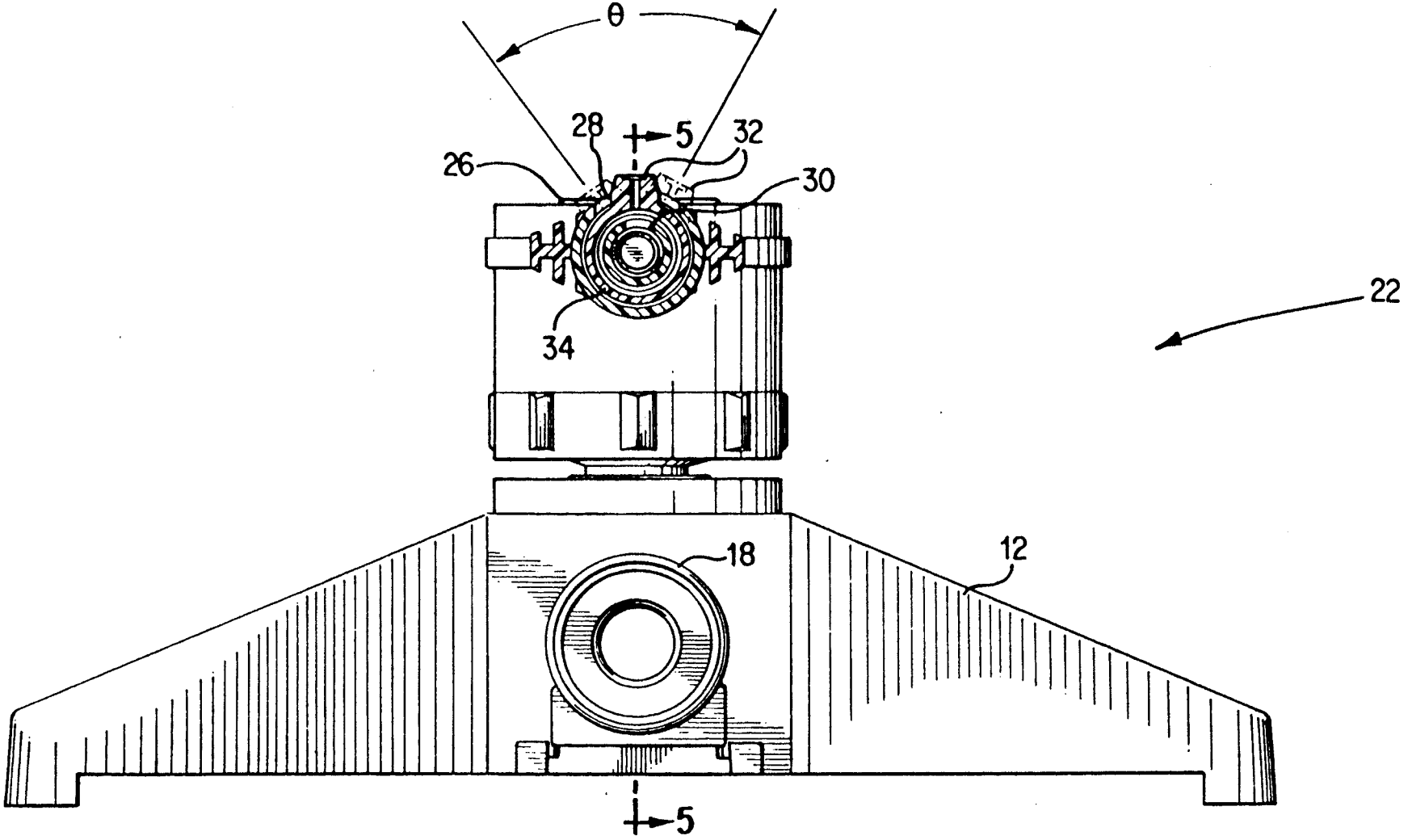
FIG. 4 is an end elevational view of the alternative embodiment shown in FIG. 2, with a partial sectional view shown taken along lines 4—4 of FIG. 3.

Disposed concentrically between the distal end of arm 16 and nozzle base 26 is nozzle unit 32, having a generally cylindrical body portion 34 and an upper nozzle portion 36. Nozzle unit 32 is both slidable along, and rotatable about, the longitudinal axis of arm 16, the limits of such movement of nozzle unit 32 being defined by the boundaries of opening 28 in nozzle base 26. As shown in FIG. 4 nozzle unit 32 is rotatable through an angle $\theta$ which, preferably, is approximately 50°, so that nozzle unit 32 is rotatable about 25° in either direction from its vertical position Collar 38 is fixedly secured to arm 16 at a generally intermediate portion thereof, adjacent nozzle base 26. Collar 38 includes a finger 40, which selectively engages one of detents 42A, 42B, or 42C to provide longitudinal indexing for nozzle unit 32. O-rings 44 and 46 provide a positive seal between arm 16 and body portion 34 of nozzle unit 32 regardless of the position of nozzle unit 32.

Figure 6:
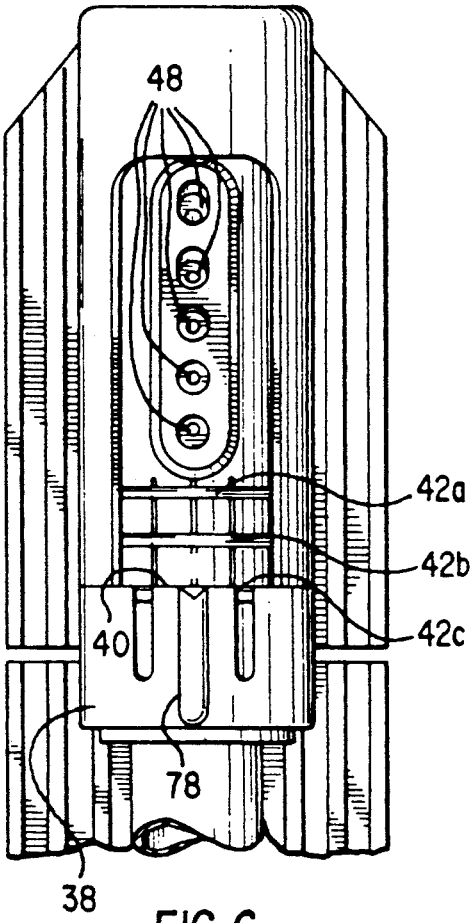
FIG. 6 is an enlarged top plan view of a representative end portion of one spray arm, shown in a first spray setting.
Figure 7:
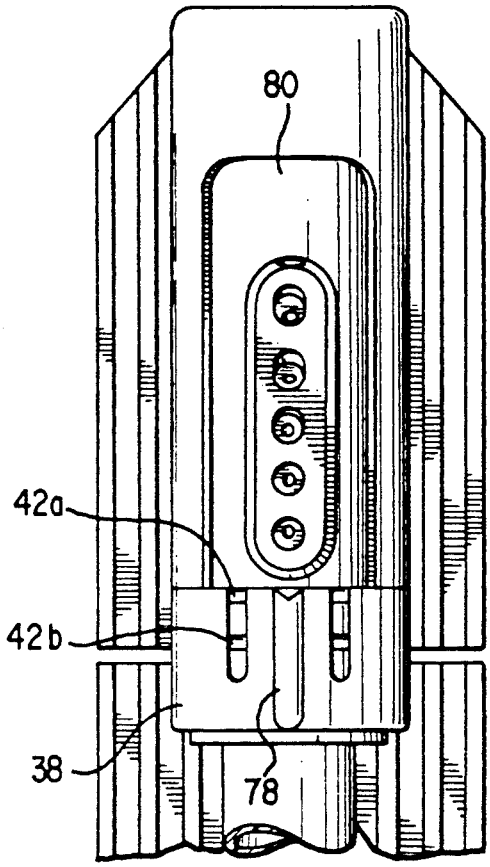
FIG. 7 is an enlarged top plan view of a representative end portion as illustrated in FIG. 6, showing the end portion in a second spray setting.

In the preferred embodiments shown, nozzle portion 36 of nozzle unit 32 has six nozzles 48 formed therethrough for discharging water onto the user's lawn. Nozzle unit 32 is selectively movable between three longitudinal positions, each such position corresponding to a separate detent 42A, 42B, or 42C, with each longitudinal position placing a different number of nozzles 48 in fluid communication with opening 30. In FIG. 6, for instance, nozzle unit 32 is in its outermost position (also shown in FIG. 5), wherein all six nozzles 48 are communicating with the water supply through opening 30, thereby dispensing the maximum amount of water onto the users lawn. In FIG. 7, nozzle unit 32 is shown in its innermost position, wherein only four of nozzles 48 are in communication with the water supply, the remaining two nozzles 48 being maintained in an inoperative position by virtue of the sealing effect of O-ring 46. It will be readily understood from this disclosure that a third longitudinal position for nozzle unit 32, corresponding to detent 42B, is also provided, wherein five nozzles 48 are placed in an operative position for communicating with the water supply through opening 30.

As discussed above, nozzle unit 32 is also rotatably adjustable through the angle $\theta$ shown in FIG. 4. When nozzle unit 32 is positioned such that nozzles 48 are angularly oriented relative to their vertical position, the force of water discharged through nozzles 48 provides a driving thrust, whereby arms 16 and body 24 (or body 14, as the case may be) are rotated relative to base 12. By selectively varying the angular orientation of each nozzle unit 32, the user of the present invention can govern the rotational velocity of the arm hub. By further adjusting the number of nozzles 48 utilized to distribute water, the user can effectively control both the spray pattern and quantity of water distributed onto a lawn by this invention.

Figures 5, 5A:
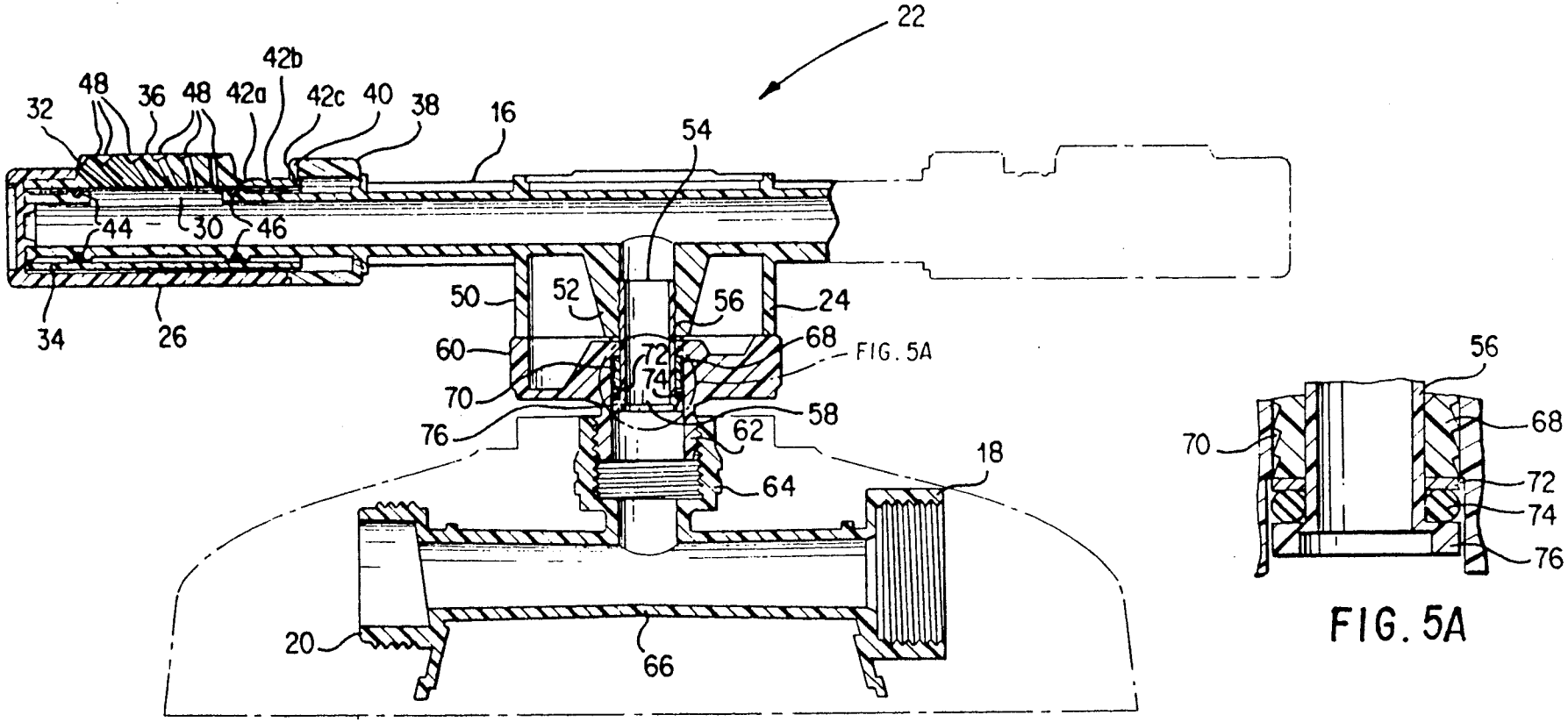
FIG. 5 is a side partially sectioned view of the alternative embodiment taken along line 5—5 of FIG. 4.
FIG. 5A is an enlarged portion taken from FIG. 5.

Referring now primarily to FIG. 5, body 24 comprises a generally cylindrical outer portion 50 and an inner portion 52, both of which are integrally formed with arms 16. The upper end 54 of stem 56 is press fit into the interior of inner portion 52, with the lower end 58 of stem 56 being retained within connector nut 60. Upper end 54 of stem 56 preferably includes a plurality of ridges formed on the outer surface thereof to provide a secure fitting within inner portion 52 of body 24. The lower portion 62 of connector nut 60 has external threads formed thereon and is engaged with internally threaded upper portion 64 of tee 66, which is an integrally formed unit comprising water inlet 18 and water outlet 20.

In order to insure the free rotation of the arm hub, bushing 68 is press fit into the cylindrical inner cavity 70 of connector nut 60. Preferably, bushing 68 is formed of 70/30 annealed brass, with the polished interior surface providing a suitable bearing surface for rotation of stem 56 therein. As clearly shown in FIG. 5A, thrust washer 72 is operatively disposed between the lower edge of bushing 68 and O-ring 74, both of which are retained by annular shoulder 76 on lower end 58 of stem 56. Stem 56 is preferably formed of a relatively low friction plastic material, which will enable stem 56 to rotate freely within bushing 68. Thrust washer 72 should be composed of a low friction material suitable for withstanding the compressive load between shoulder 76 and bushing 68, while allowing free rotation of thrust washer 72, O-ring 74, and stem 56 as a unit.

As those skilled in the art will readily understand, operation of the present invention is easily accomplished by attaching a conventional water hose to water inlet 18, with water outlet 20 being capped. Tee 66, being hollow, provides a passageway through base 12 for directing the incoming water upwardly through stem 56 and outwardly through the internal passageways of arms 16. O-ring 74 operates to prevent any leakage as water passes from lower threaded portion 62 of connector nut 60 into stem 56. Upon reaching the distal ends of arms 16, the water exits through openings 30 and is suitably discharged through nozzles 48, with O-rings 44 and 46 preventing any unwanted leakage in the distal end of arms 16.

As shown in FIGS. 6 and 7, the upper portion of collar 38 preferably includes a centrally located raised member 78, which serves as relative index means for determining the rotational orientation of nozzle unit 32 relative to arms 16. It may also be desirable to include numerical indicia disposed on nozzle unit 32 to visually indicate the number of nozzles 48 utilized in each longitudinal setting corresponding to detents 42A, 42B, and 42C. Such indicia may be included on the external surface of body portion 34 of nozzle unit 32 between detents 42A, 42B, and 42C, or may be placed along the surface of nozzle unit 32 in the area generally designated by the numeral 80 in FIG. 7.

While the rotary sprinkler of the present invention has been illustrated and described in conjunction with two embodiments thereof, it will be appreciated that many variations in the embodiments disclosed herein may be incorporated without departing from the scope of this invention. The foregoing detailed description is to be clearly understood as given by way of illustration and example only, the spirit and scope of this invention being limited solely by the appended claims.

What is claimed is:

1. A sprinkler, comprising:

a base, having an inlet and an outlet;

a body, rotatably secured to said base, having a central portion with a first internal passageway formed therein, said first internal passageway being in fluid communication with said outlet on said base;

a plurality of arms secured to said body and extending radially therefrom, each said arm having an internal passageway formed therein maintained in fluid communication with said first internal passageway in said body, each said arm having a distal end portion with a generally upward facing opening formed therein; and a plurality of nozzle units, equal in number to said plurality of arms, slidably disposed on said distal end portions of said arms and covering at least a portion of said openings formed therein, each said nozzle unit having a plurality of nozzles formed therethrough suitable for discharging water, each said nozzle unit being selectively movable longitudinally between multiple positions along said distal end portion of one of said arms, with each said position placing a different number of said nozzles in fluid communication with said internal passageway of the respective arm through said opening in said distal end portion thereof, wherein at least one of said nozzles is maintained in constant fluid communication with said internal passageway.

2. A sprinkler as set forth in claim 1, wherein:

said plurality of arms and said body comprise a unitary assembly; and at least one said nozzle unit is selectively rotatably movable about the longitudinal axis of its respective arm; whereby the force of water discharging from said at least one nozzle unit operates to rotate said unitary assembly relative to said base.

3. A sprinkler as set forth in claim 2, wherein:

the respective number of said arms and nozzle units is two.

4. A sprinkler as set forth in claim 2, wherein:

the respective number of said arms and nozzle units is three; and the rotational speed of said unitary assembly relative to said base is variably determinable by the angular orientation of said nozzle units.

5. A sprinkler as set forth in claim 2, wherein:

the respective number of said arms and nozzle units is two; and the rotational speed of said unitary assembly relative to said base is variably determinable by the angular orientation of said nozzle units.

6. A sprinkler as set forth in claim 1, wherein:

the respective number of said arms and said nozzle units is two.

7. A sprinkler as set forth in claim 1, wherein:

the respective number of said arms and nozzle units is three.

8. A sprinkler as set forth in claim 1, wherein:

the number of said nozzles on each said nozzle unit is six.

9. A sprinkler as set forth in claim 8, wherein:

each said nozzle unit is selectively movable between first, second, and third positions, said first position placing all six said nozzles in fluid communication with said internal passageway in said arm, said second position placing five said nozzles in fluid communication with said internal passageway in said arm, and said third position placing four said nozzles in fluid communication with said internal passageway in said arm.

10. A sprinkler as set forth in claim 1, further comprising:

means for indexing said nozzle units at each of said multiple positions on said distal end positions of said arms.

11. A sprinkler as set forth in claim 10, wherein said indexing means comprise:

a plurality of detents formed in a portion of each said nozzle units, said portion being slidably received within a collar disposed on each said arm; and a finger formed on said collar, said finger being located and adapted to engage one of said plurality of detents for each of said multiple positions of said nozzle units.

12. A sprinkler, comprising:

a base member, having a water inlet and first and second water outlets, said water inlet being adapted to operatively engage a hose suitable for providing a supply of water to said sprinkler, said first water outlet being adapted to operatively engage a hose suitable for directing a portion of said water outwardly from said sprinkler, said second water outlet being generally centrally located within said base and opening upwardly;

a body member, rotatably mounted on said base member, having a vertically oriented, generally tubular stem portion in fluid communication with said second water outlet leading to an internal passageway formed within said body member;

a plurality of arms integrally formed with said body member and extending radially therefrom, each said arm comprising a generally tubular wall portion with an internal passageway formed therein maintained in fluid communication with said passageway in said body member, each said arm also having a distal end with an elongate opening formed in said wall portion thereof; and a plurality of nozzle units, one slidably mounted on each said distal end of each said arm, each said nozzle unit having a plurality of nozzles formed therein suitable for discharging water from said sprinkler, said nozzles being selectively positionable in fluid communication with said internal passageway in said arms through said elongate openings, wherein each said nozzle unit is selectively movable between a plurality of longitudinal settings, each said setting providing a different number of said nozzles positioned in fluid communication with said internal passageway in said arm.

13. A rotary sprinkler as set forth in claim 12, wherein:

each said nozzle unit has a longitudinal axis associated therewith; and at least one said nozzle unit is selectively rotatable between a plurality of angular orientations about its longitudinal axis, wherein rotation of said body member is effected by the water being discharged from said at least one said nozzle unit having an angular orientation other than zero degrees relative to the vertical.

14. A rotary sprinkler as set forth in claim 13, wherein:

said body member is rotatable at a multiplicity of angular velocities, said velocities being at least partially determined by said angular orientation of said at least one nozzle unit.

15. A rotary sprinkler as set forth in claim 13, wherein:

each said nozzle unit is independently rotatable about its respective longitudinal axis.

16. A rotary sprinkler as set forth in claim 13, wherein:

said at least one nozzle unit is rotatable through a total angle of about fifty degree, approximately twenty-five degrees to either side of vertical.

17. A rotary sprinkler as set forth in claim 12, wherein:

the number of said plurality of arms is two.

18. A rotary sprinkler as set forth in claim 12, wherein:

the number of said plurality of arms is three.

19. A rotary sprinkler as set forth in claim 12, wherein:

said plurality of arms lie in a substantially horizontal plane.

20. A rotary sprinkler for distributing water, comprising:

a base, having a fluid inlet and a fluid outlet and an internal flow passage therebetween;

a body, rotatably secured to said base, having an internal flow passage formed therein communicating with said fluid outlet; and at least one arm integrally formed with said body and extending radially therefrom, said arm having an internal flow passage formed therein communicating with said passage in said body, and an opening communicating with said passage through which water is discharged, said at least one arm further including a nozzle unit slidably engaged thereon, said nozzle unit communicating with said opening and having a plurality of nozzles formed therein adapted to direct water outwardly from said arm, said nozzle unit being selectively movable longitudinally between a plurality of positions, each said position allowing a different number of said nozzles to communicate with said opening.

21. A rotary sprinkler as set forth in claim 20, wherein;

said at least one arm has a longitudinal axis associated therewith, and;

said nozzle unit is at least partially rotatable about said longitudinal axis and selectively positionable in a plurality of angular orientations, whereby positioning said nozzle unit at one of said angular orientations other than substantially vertical produces a lateral component in the direction of water being discharged therefrom, the force of the discharged water being sufficient to drive said arm laterally thereby effecting rotation of said body.

22. A rotary sprinkler as set forth in claim 20, wherein:

said body includes two said arms integrally formed therewith and extending generally radially therefrom, each said arm having a nozzle unit operatively disposed thereon.

23. A rotary sprinkler as set forth in claim 20, wherein:

said body includes three said arms integrally formed therewith and extending generally radially therefrom, each said arm having a nozzle unit operatively disposed thereon.

24. A rotary sprinkler as set forth in claim 20, wherein:

said nozzle unit includes six said nozzles formed therein and is selectively movable between first, second, and third longitudinal positions, said first position allowing all six of said nozzles to communicate with said opening in said arm, said second position allowing five of said nozzles to communicate with said opening, and said third position allowing four of said nozzles to communicate with said opening.

* * * * *